US010459409B2

(12) United States Patent
Hasegawa

(10) Patent No.: US 10,459,409 B2
(45) Date of Patent: Oct. 29, 2019

(54) ELECTRONICS TIMEPIECE, METHOD OF CONTROLLING LOCATION INFORMATION RETRIEVAL, AND STORAGE MEDIUM

(71) Applicant: CASIO COMPUTER CO., LTD., Tokyo (JP)

(72) Inventor: Kosuke Hasegawa, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 123 days.

(21) Appl. No.: 15/845,735

(22) Filed: Dec. 18, 2017

(65) Prior Publication Data

US 2018/0173170 A1 Jun. 21, 2018

(30) Foreign Application Priority Data

Dec. 21, 2016 (JP) ..... 2016-247358

(51) Int. Cl.
*G04R 20/02* (2013.01)
*G04R 20/04* (2013.01)
*G04R 20/06* (2013.01)

(52) U.S. Cl.
CPC ..... *G04R 20/02* (2013.01); *G04R 20/04* (2013.01); *G04R 20/06* (2013.01)

(58) Field of Classification Search
CPC ..... G04R 20/02; G04R 20/04; G04R 20/06
See application file for complete search history.

(56) References Cited

FOREIGN PATENT DOCUMENTS

JP H9-297191 A 11/1997

*Primary Examiner* — Daniel P Wicklund
(74) *Attorney, Agent, or Firm* — Chen Yoshimura LLP

(57) ABSTRACT

An electronic timepiece includes a clock circuit, a receiver that receives radio waves from positioning satellites, an operation receiving unit, and a control unit constituted by a CPU and a module controller. The control unit makes the receiver perform either one of a date and time reception process that attempts to obtain date and time information and a positioning reception process that attempt to obtain information needed to obtain the current location; and, when a prescribed input operation that affects the current region setting is received, the control unit makes the receiver perform the positioning reception process at least once in the reception operations that are performed after receiving the prescribed input operation before a prescribed location updating event that determines a current location of the electronic timepiece occurs.

20 Claims, 8 Drawing Sheets

ELECTRONICS TIMEPIECE, METHOD OF CONTROLLING LOCATION INFORMATION RETRIEVAL, AND STORAGE MEDIUM

BACKGROUND OF THE INVENTION

The present invention relates to an electronic timepiece, a method of controlling location information retrieval, and a storage medium.

Some conventional electronic timepieces have features for switching among different local times of various areas around the world and then displaying information or performing other processes. In such electronic timepieces, the user can manually specify the current location to display the local time in that current location. Some electronic timepieces also have a world clock feature that allows desired global locations to be specified in addition to the current location and displays the local time in the specified locations.

Moreover, there are also technologies that, in addition to allowing the user to manually set the local time as described above, can also receive transmitted radio waves from positioning satellites to identify the current location and then set and display the local time in that current location. For example, Japanese Patent Application Laid-Open Publication No. H9-297191 describes a method of receiving satellite radio waves at a prescribed interval to perform a positioning process and then, if the obtained current location does not match the location corresponding to the currently set location information, updating the location information and changing the displayed date and time. There are also conventional technologies for receiving transmitted radio waves from positioning satellites to obtain date and time information and then updating the internally kept date and time of the electronic timepiece to maintain accuracy.

However, in electronic timepieces, and particularly in mobile electronic timepieces where light weight and compact size are required, the power consumption and load required to receive satellite radio waves are significantly larger than those required for other operations. Therefore, it is desirable that load-intensive positioning operations with long reception times be performed no more often than is necessary.

Meanwhile, if the period of time from when the user changes locations until the positioning operation is performed is long, the local time may potentially be displayed incorrectly for a long period of time. Therefore, currently the easiest solution is to set the current location on the basis of a manual operation performed by the user upon changing locations.

However, when the user manually sets the local time, the time may sometimes be set incorrectly depending on whether daylight saving time is currently in effect, for example. Meanwhile, even if the positioning operation is triggered manually when changing the local time setting, many users may not have actually arrived at the target destination by the point at which they want to change the time, such as while riding transportation such as airplanes and trains or while waiting in buildings such as airports and terminal stations, and it is also common for users to be in environments where satellite radio waves do not reach or are otherwise difficult to receive. In both cases, it is difficult to confirm whether the correct location has been set.

SUMMARY OF THE INVENTION

The present invention provides an electronic timepiece, a method of controlling location information retrieval, and a storage medium. Accordingly, the present invention is directed to a scheme that substantially obviates one or more of the problems due to limitations and disadvantages of the related art.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides an electronic timepiece, including: a clock that keeps a current time; a radio wave receiver that receives radio waves transmitted from positioning satellites; an operation receiving unit that receives input operations; and a control unit, wherein the control unit calculates, on the basis of the current time kept by the clock, a local time or local times in one or a plurality of setting regions including at least a current region in which the electronic timepiece is currently located, wherein when the radio wave receiver performs reception operations that attempt to receive the radio waves, the control unit makes the radio wave receiver perform either one of a date and time reception process that attempts to obtain date and time information from the radio waves without obtaining additional information from the radio waves needed to determine a current location of the electronic timepiece and a positioning reception process that attempts to obtain all of information from the radio waves that is needed to determine the current location of the electronic timepiece, wherein when the operation receiving unit receives a prescribed input operation that affects the current region and, if the prescribed input operation manually changes a current region setting, when the control unit is not set to prioritize said manually changed current region setting, the control unit makes the radio wave receiver perform the positioning reception process at least once before a prescribed location updating event that determines a current location of the electronic timepiece occurs, the prescribed location updating event being when the current location of the electronic timepiece is determined by a communication with an external device or by successfully performing the positioning reception process that occurs immediately or a prescribed time period after the reception of the prescribed input operation, whichever occurs first after the reception of the prescribed input operation, and wherein when the prescribed location updating event occurs, the control unit at least temporarily makes the radio wave receiver stop the reception operations that attempt to receive the radio waves or the control unit makes the radio wave receiver perform only the date and time reception process when performing the reception operations until another prescribed input operation that affects the current region is received.

In another aspect, the present disclosure provides a method of controlling location information retrieval to be performed by a control unit in an electronic timepiece, the electronic timepiece including a clock that keeps a current time, a radio wave receiver that receives radio waves transmitted from positioning satellites, an operation receiving unit that receives input operations, and the control unit, the control unit calculating, on the basis of the current time kept by the clock, a local time or local times in one or a plurality of setting regions including at least a current region in which the electronic timepiece is currently located, the method including having the control unit perform the following: when the radio wave receiver performs reception operations that attempt to receive the radio waves, making the radio wave receiver perform either one of a date and time reception process that attempts to obtain date and time information from the radio waves without obtaining additional information from the radio waves needed to determine a current location of the electronic timepiece and a positioning reception process that attempts to obtain all of information from the radio waves that is needed to determine the current location of the electronic timepiece; when the operation receiving unit receives a prescribed input operation that affects the current region and, if the prescribed input operation manually changes a current region setting, when the control unit is not set to prioritize said manually changed current region setting, making the radio wave receiver perform the positioning reception process at least once before a prescribed location updating event that determines a current location of the electronic timepiece occurs, the prescribed location updating event being when the current location of the electronic timepiece is determined by a communication with an external device or by successfully performing the positioning reception process that occurs immediately or a prescribed time period after the reception of the prescribed input operation, whichever occurs first after the reception of the prescribed input operation; and when the prescribed location updating event occurs, at least temporarily making the radio wave receiver stop the reception operations that attempt to receive the radio waves or making the radio wave receiver perform only the date and time reception process when performing the reception operations until another prescribed input operation that affects the current region is received.

In another aspect, the present disclosure provides a non-transitory storage medium having stored therein instructions executable by one or more processors in an electronic timepiece, the electronic timepiece including a clock that keeps a current time, a radio wave receiver that receives radio waves transmitted from positioning satellites, an operation receiving unit that receives input operations; and the one or more processors, the said one or more processor calculating, on the basis of the current time kept by the clock, a local time or local times in one or a plurality of setting regions including at least a current region in which the electronic timepiece is currently located, the instructions causing the one or more processors in the electronic timepiece to perform the following: when the radio wave receiver performs reception operations that attempt to receive the radio waves, making the radio wave receiver perform either one of a date and time reception process that attempts to obtain date and time information from the radio waves without obtaining additional information from the radio waves needed to determine a current location of the electronic timepiece and a positioning reception process that attempts to obtain all of information from the radio waves that is needed to determine the current location of the electronic timepiece; when the operation receiving unit receives a prescribed input operation that affects the current region and, if the prescribed input operation manually changes a current region setting, when the control unit is not set to prioritize said manually changed current region setting, making the radio wave receiver perform the positioning reception process at least once before a prescribed location updating event that determines a current location of the electronic timepiece occurs, the prescribed location updating event being when the current location of the electronic timepiece is determined by a communication with an external device or by successfully performing the positioning reception process that occurs immediately or a prescribed time period after the reception of the prescribed input operation, whichever occurs first after the reception of the prescribed input operation; and when the prescribed location updating event occurs, at least temporarily making the radio wave receiver stop the reception operations that attempt to receive the radio waves or making the radio wave receiver perform only the date and time reception process when performing the reception operations until another prescribed input operation that affects the current region is received.

It is to be understood that both the foregoing general description and the following detailed description are exemplary and explanatory, and are intended to provide further explanation of the invention as claimed.

DETAILED DESCRIPTION OF THE EMBODIMENTS

Embodiments of the present invention will be described below with reference to figures.

Embodiment 1

First, an electronic timepiece 1 according to Embodiment 1 will be described.

Figure 1:
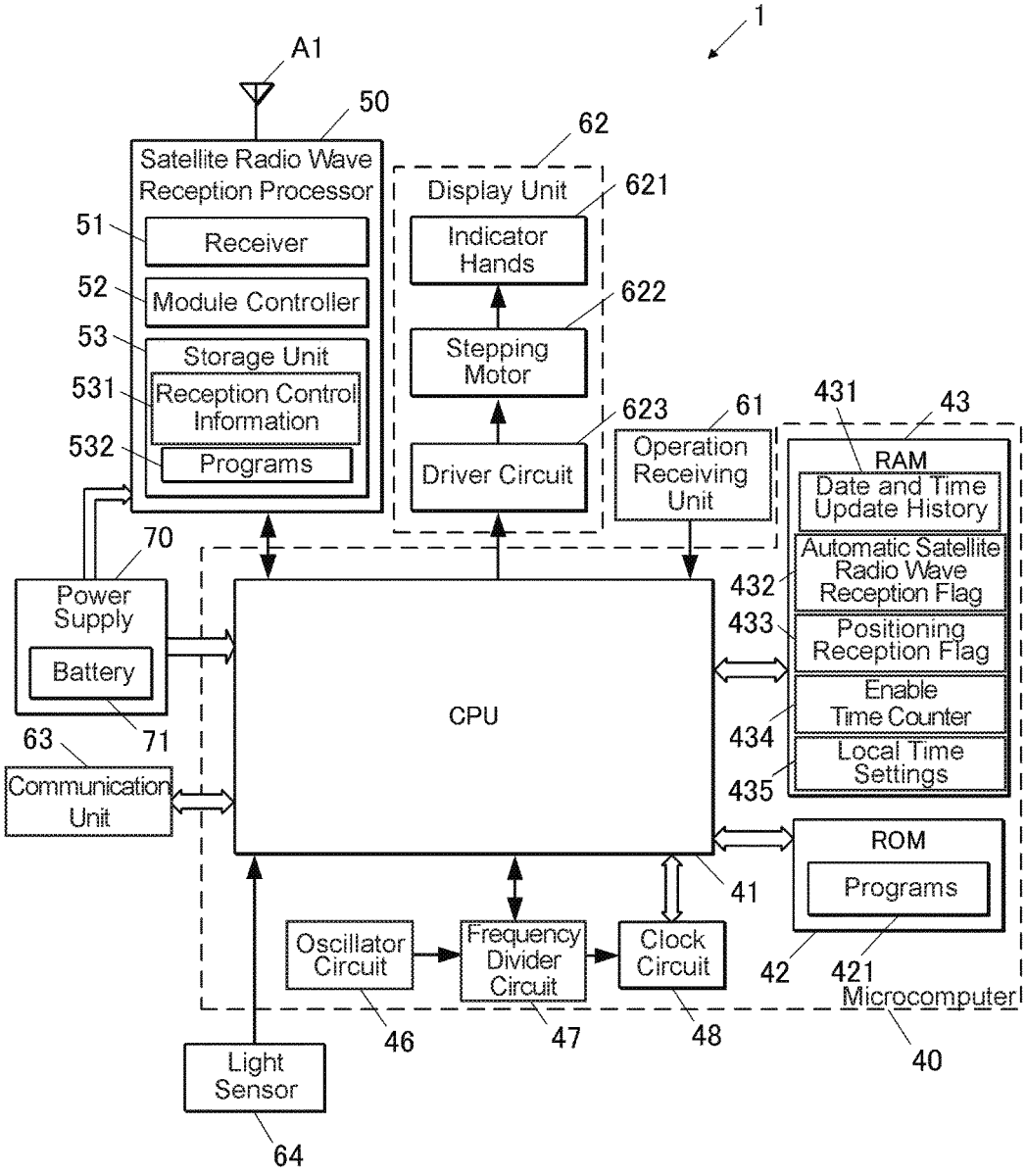
FIG. 1 is a block diagram illustrating a functional configuration of an electronic timepiece according to Embodiment 1 of the present invention.

FIG. 1 is a block diagram illustrating a functional configuration of the electronic timepiece 1 according to Embodiment 1 of the present invention.

Here, the electronic timepiece 1 is a wristwatch or the like that is affixed to the user's body or a pocket watch or the like, for example, but is not limited to these examples.

The electronic timepiece 1 includes a microcomputer 40, a satellite radio wave reception processor 50 and an antenna A1, an operation receiving unit 61, a display unit 62, a communication unit 63, a light sensor 64, a power supply 70, and the like.

The microcomputer 40 centrally controls the overall behavior of the electronic timepiece 1. The microcomputer 40 includes a central processing unit (CPU) 41, a read-only memory (ROM) 42, a random-access memory (RAM) 43 (settings storage unit), an oscillator circuit 46, a frequency divider circuit 47, a clock circuit 48 (clock unit), and the like.

The CPU 41 is a processor that performs various computational processes and handles control operations. The ROM 42 stores programs 421 that the CPU 41 runs to execute control operations, as well as default settings data and the like. The ROM 42 may include a mask ROM and/or non-volatile memory such as rewritable flash memory. The programs 421 include control programs for a date and time update control process, a reception configuration process, and a satellite radio wave reception control process (described below).

The RAM 43 provides a working memory space for the CPU 41 and stores temporary data.

The RAM 43 stores local time settings 435, which include time zone settings and daylight saving time settings for displaying and using the current dates and times (local times) in a region corresponding to the current location (home city; current region; first setting region) and in other specified global regions (world clock cities; second setting regions (that is, a plurality of setting regions)). In this example, these regions respectively correspond to official global time zones, but when more detailed settings are possible, these regions may be set for each area having a different combination of time zone and daylight saving time settings, or these regions may be set individually on a per-administration basis for each country or the like having the same combination of time zone and daylight saving time settings.

The local time settings 435 are either set manually via user input operations to the operation receiving unit 61 (in other words, when the user inputs the intended region or an incorrect region, this manually set current region may potentially be a region that does not actually include the current location of the electronic timepiece 1) or are set automatically in accordance with a current location obtained by a positioning operation performed by the satellite radio wave reception processor 50. This positioning operation may be a positioning command issued in the form of a prescribed user input operation to the operation receiving unit 61 or a positioning process that is automatically executed at a prescribed timing or under prescribed conditions. The CPU 41 can use these local time settings 435 to convert the date and time kept by the clock circuit 48 to the local time in the home city or a world clock city and then output the result.

The RAM 43 also stores and maintains a date and time update history 431, an automatic satellite radio wave reception flag 432, a positioning reception flag 433, and an enable time counter 434. The date and time update history 431 records a history of when external date and time information is retrieved and the date and time kept by the clock circuit 48 is updated. This historical information may also include information indicating how the date and time information was retrieved. The automatic satellite radio wave reception flag 432 is a binary flag that determines whether to use radio waves received by the satellite radio wave reception processor 50 from positioning satellites when automatically receiving (obtaining) date and time information at a prescribed frequency. When this flag is set, date and time information is obtained by receiving radio waves from positioning satellites according to the conditions described below. When this flag is reset, radio waves from positioning satellites are not automatically received, and date and time information is obtained in the form of Bluetooth (registered trademark) communications from an external device paired via Bluetooth.

The positioning reception flag 433 is a binary flag that determines, when automatically receiving transmitted radio waves from positioning satellites, whether to not only receive date and time information (date and time reception process) but also receive information needed for positioning (positioning reception process) and perform the positioning operation. The enable time counter 434 is a value that, when automatically receiving satellite radio waves while the positioning reception flag 433 is set (that is, while the positioning operation is enabled), indicates the remaining time for which the positioning operation will be performed (that is, the remaining time until the positioning reception flag 433 is reset). When the positioning reception flag 433 is OFF (that is, the positioning operation is disabled), the enable time counter 434 takes a value of 0. When the enable time counter 434 is set to a non-zero value, the period of time corresponding to that value starting from when that value was set represents the maximum time for which the positioning operation will be performed.

The oscillator circuit 46 generates and outputs a signal having a prescribed frequency. This signal is generated using a crystal oscillator or the like, for example. This crystal oscillator may alternatively be arranged outside of the microcomputer 40.

The frequency divider circuit 47 divides the frequency signal input from the oscillator circuit 46 by a specified division ratio and outputs the resulting divided signal. The division ratio setting may be changed by the CPU 41.

The clock circuit 48 counts pulses in the divided signal input from the frequency divider circuit 47, which has a prescribed frequency, in order to keep track of the current date and time (the current time of day and date of year). The current date and time kept by the clock circuit 48 can be updated by a control signal from the CPU 41 on the basis of a more accurate current date and time or the like obtained from the satellite radio wave reception processor 50.

The satellite radio wave reception processor 50 receives and processes transmitted radio waves from positioning satellites in a satellite navigation system such as the United States Global Positioning System (GPS) (a reception operation) to obtain date and time information and current location information and then outputs this information to the CPU 41. The satellite radio wave reception processor 50 includes a receiver 51 (a radio receiver), a module controller 52, a storage unit 53, and the like.

The receiver 51 detects and receives transmitted radio waves from target positioning satellites, performs an acquisition process to determine the identities of those positioning satellites and the phases of the transmission signals therefrom, tracks the transmitted radio waves from the acquired positioning satellites on the basis of the identification information and phases of those positioning satellites, and continuously demodulates and obtains the transmission signals (navigation messages).

The module controller 52 includes a CPU or the like and performs various processes to control the behavior of the satellite radio wave reception processor 50. The module controller 52 obtains the necessary information from the extracted signals to determine the current date and time and calculate the current location (that is, perform positioning). The module controller 52 gets, on the basis of the format of the navigation messages from the currently available positioning satellites, at least the portion of the transmitted information from the positioning satellites required to obtain the desired target information. When the desired information from signals (on the L1 band) from GPS positioning satellites (hereinafter, "GPS satellites") is date and time information, only the date and time information (if the date can be determined from the date and time kept by the clock circuit 48, at least the time of week (TOW) count) and the time of receipt thereof need to be received (date and time reception process) and obtained. Moreover, when obtaining the information needed for positioning (that is, for obtaining the current location of the electronic timepiece 1), in addition to this date and time information and time of receipt thereof, the orbit information of the acquired GPS satellites (orbital parameters or position, speed, and acceleration) are received (positioning reception process) and obtained. In other words, the amount of data received during the positioning reception process is greater than during the date and time reception process, which typically increases reception times and thereby increases the power consumption of the reception operation. After obtaining the information needed for positioning, the module controller 52 can calculate the current location on the basis of the orbit information of the GPS satellites and the offsets between the current date and time values obtained from those GPS satellites, and the distances between the GPS satellites and the current location can be used to calculate the time delay relative to the accurate date and time given by the determined date and time.

The storage unit 53 stores reception control information 531 such as various types of settings data and reception information as well as programs 532 that the module controller 52 executes to control the satellite radio wave reception processor 50. The settings data includes the formats of the navigation messages from the positioning satellites, reference data for determining reception level, and the like, for example. Moreover, the reception information includes predicted orbit information for the acquired positioning satellites (an almanac), notification information about addition of leap seconds, and the like, for example.

The operation receiving unit 61 receives external input operations such as user operations or the like. The operation receiving unit 61 includes one or more push-button switches, for example, and outputs signals to the CPU 41 in accordance with which push-button switches are pressed.

The display unit 62 is controlled by the CPU 41 to display various types of information. The display unit 62 includes a plurality of rotatably attached indicator hands 621, a stepping motor 622 that rotates this plurality of indicator hands 621, a driver circuit 623 for the stepping motor 622, and the like. The plurality of indicator hands includes an hour hand, a minute hand, and a second hand and may further include additional feature hands or the like for displaying information related to prescribed features. Alternatively, in addition to or instead of displaying information using these hands, the display unit 62 may be configured to display information using a digital display screen such as a liquid crystal display screen (LCD). The content displayed by the display unit 62 includes information related to the current date and time.

The communication unit 63 is controlled by the CPU 41 to perform various operations related to communicating with external electronic devices via short-range wireless communications (wireless communications; here, Bluetooth). The communication unit 63 performs a control operation based on a prescribed communication standard, demodulates and obtains communication data sent to the electronic timepiece 1 and outputs that data to the CPU 41, and modulates communication data for external communication partner devices and outputs that data as communication radio waves.

The light sensor 64 is arranged parallel to the display screen of the display unit 62, for example, and measures the amount of incoming light from the external environment. A photodiode is used for the light sensor 64, for example. The light sensor 64 outputs an electrical signal (a voltage signal or a current signal) corresponding to the amount of incident light, and this electrical signal is digitally sampled by an analog-to-digital converter (ADC; not illustrated in the figure) and then input to the CPU 41.

The power supply 70 supplies the electrical power needed for the components of the electronic timepiece 1 to operate to those components. The power supply 70 supplies power output from a battery 71 to the components in the form of an operating voltage. If there are components that operate at different operating voltages, the power supply 70 uses a regulator to convert to and output the necessary voltages. The battery 71 may include a solar panel for generating power from incident light and a secondary battery or the like for storing the generated power or may include removably configured dry cell batteries or rechargeable batteries or the like.

In the configuration described above, the CPU 41 and the module controller 52 of the satellite radio wave reception processor 50 form a control unit of one aspect of the present invention.

Next, local time settings in the electronic timepiece 1 according to Embodiment 1 will be described.

In the electronic timepiece 1, the region (home city; current region) corresponding to the current location of the electronic timepiece 1 (that is, the user) is set (home city setting), and the desired world cities (world clock cities) are set (world clock settings). During normal date and time display, the local time corresponding to the time zone and current daylight saving time status for the home city is displayed and used for various operations such as alarm features. Moreover, in the electronic timepiece 1, a prescribed input operation to the operation receiving unit 61 makes it possible to temporarily switch to displaying the local time corresponding to the time zone and current daylight saving time status for a world clock city. Alternatively, depending on the electronic timepiece, it may be possible to simultaneously display the local time in the home city as well as the local time in a world clock city.

The method of setting the home city and world clock cities is not particularly limited, but in this example, a prescribed indicator hand 621 such as the seconds hand that can be rotated by an input operation to the operation receiving unit 61 (such as rotating the crown) is rotated to point to (directly specify) entries in a list of world city names arranged in a ring shape around the periphery of the dial of the electronic timepiece 1, for example.

Moreover, the electronic timepiece 1 can switch between the home city and world clock cities on the basis of a prescribed user input operation (a switching command) to the operation receiving unit 61.

Furthermore, when the user performs a prescribed input operation to issue a command to make the satellite radio wave reception processor 50 perform the positioning operation (that is, get the current location; a positioning command), or when the user inputs a command to establish a communication connection with an external device to get the date and time or location information, the home city setting is updated according to the retrieved current location.

Next, operations for getting the date and time and the current location will be described.

In the date and time kept by the clock circuit 48, offsets of up to approximately 0.5 seconds per day, for example, may occur due to factors such as the oscillation frequency precision of the crystal oscillator or the environment in which the electronic timepiece 1 is used. In the electronic timepiece 1 according to the present embodiment, the satellite radio wave reception processor 50 and the communication unit 63 respectively receive transmitted radio waves from positioning satellites and communication radio waves from external electronic devices (external devices), thereby making it possible to obtain accurate date and time information from an external source (here, the positioning satellites or the external devices) at an appropriate frequency (a prescribed frequency) and then update the date and time of the clock circuit 48 on the basis of the obtained date and time information.

If the electronic timepiece 1 is paired via a Bluetooth communication connection with an external device such as a smartphone, a mobile phone, or a portable computing device such as a tablet, the electronic timepiece 1 establishes a communication connection with that external device four times per day at prescribed times of day to get date and time information and current location information. The current location information obtained from the external device may be city information corresponding to the current time zone or the actual current location. If the actual current location is obtained, the CPU 41 of the electronic timepiece 1 retrieves city information corresponding to that current location. If the communication connection with the external device fails a prescribed number times (such as four times) in a row, after that prescribed number of failures has occurred, the satellite radio wave reception processor 50 receives, at a timing at which the light sensor 64 first detects a prescribed reference brightness on each day as per the date and time kept by the clock circuit 48 (that is, once per day; reception condition), the transmitted radio waves from the positioning satellites in order to get just the date and time information. Here, the reference brightness is set to approximately the level of ambient light outdoors during daytime.

In other words, the frequency at which date and time information is obtained from an external device and the frequency at which date and time information is obtained by receiving transmitted radio waves from positioning satellites may be different.

When receipt of satellite radio waves is triggered by a positioning command issued due to a user input operation, the electronic timepiece 1 gets date and time information as well as location information. Meanwhile, when receipt of satellite radio waves is triggered automatically on the basis of the condition described above or by a date and time update command issued due to a user input operation, the electronic timepiece 1 normally only gets the date and time information. However, as described below, if the user has recently changed or attempted to change the home city setting, the electronic timepiece 1 implements a control process for receiving both date and time information and location information while a prescribed condition is satisfied (method of controlling location information retrieval). Here, this prescribed condition is that less than 24 hours (a maximum time) have elapsed since the input operation for setting the home city and that current location information has yet to be obtained (including receipt of either the current location or the city corresponding to the current location from an external device via Bluetooth). Therefore, when receiving satellite radio waves within this 24-hour period (that is, at least at the time of the first reception operation), as long as current location information has not yet been obtained, information needed for positioning is retrieved in addition to the date and time information, and the positioning operation is performed.

Figure 2:
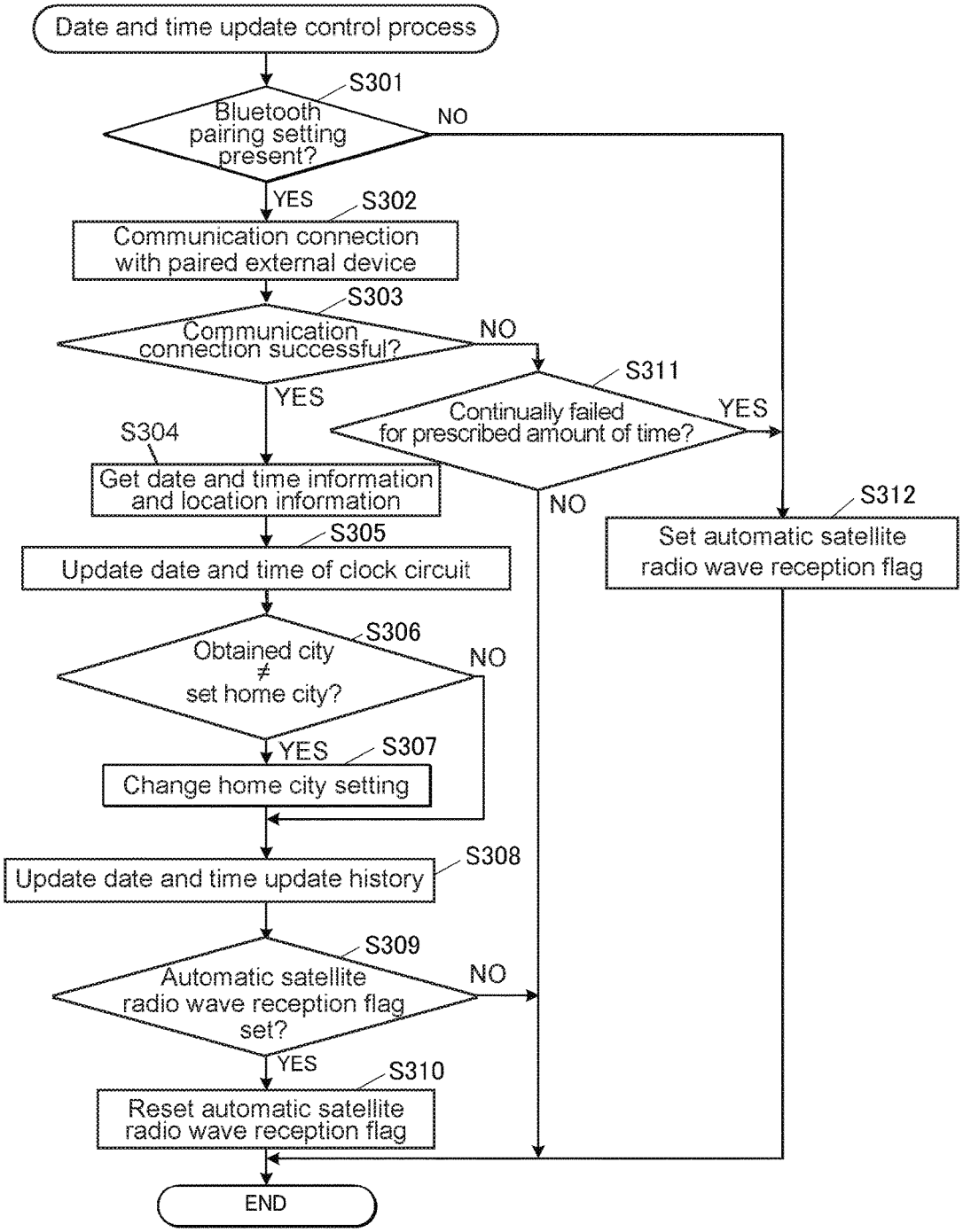
FIG. 2 is a flowchart illustrating a control procedure for a date and time update control process performed by the electronic timepiece according to Embodiment 1.

FIG. 2 is a flowchart illustrating a control procedure for the CPU 41 for the date and time update control process performed by the electronic timepiece 1 according to Embodiment 1.

This date and time update control process is automatically executed a prescribed number of times per day (four times) at prescribed times of day (here, 01:00, 07:00, 13:00, and 19:00).

Once the date and time update control process begins, the CPU 41 proceeds to step S301 and determines whether any pairing information for a Bluetooth communication partner is currently stored. If it is determined that no pairing information is currently stored (NO in step S301), the CPU 41 proceeds to step S312 and sets the automatic satellite radio wave reception flag 432. The CPU 41 then ends the date and time update control process.

Meanwhile, if it is determined that pairing information is currently stored (YES in step S301), the CPU 41 proceeds to step S302 and sends a communication connection request to the paired external device to attempt to establish a communication connection. The CPU 41 then proceeds to step S303 and determines whether the communication connection was successfully established. If it is determined that the communication connection was not successful (failed; NO in step S303), the CPU 41 proceeds to step S311 and checks the date and time update history 431 to determine whether connection attempts have continually failed during a prescribed period of time (24 hours) or greater. Here, the connection attempts during the prescribed period of time include not only the four automatic connection attempts per day described above but also any manual connection attempts corresponding to connection commands issued on the basis of user input operations.

If it is determined that connection attempts have not continually failed during the prescribed period of time or greater (NO in step S311), the CPU 41 ends the date and time update control process. If it is determined that connection attempts have continually failed during the prescribed period of time or greater (YES in step S311), the CPU 41 proceeds to step S312.

In the determination in step S303, if it is determined that a communication connection with the external device has been successfully established (YES in step S303), the CPU 41 proceeds to step S304 and gets date and time information and location information (city) sent from the external device. The date and time information and location information from the external device may be sent upon request from the CPU 41 or may be sent from the external device automatically when a communication connection is established.

The CPU 41 then proceeds to step S305 and updates the date and time kept by the clock circuit 48 on the basis of the obtained date and time information. Next, the CPU 41 proceeds to step S306 and determines whether the city (time zone setting) corresponding to the obtained location information is different than home city currently set in the local time settings 435. If it is determined that the cities are different (YES in step S306), the CPU 41 proceeds to step S307 and changes the home city setting in the local time settings 435. The CPU 41 then proceeds to step S308. If it is determined that the cities are not different (the cities match; NO in step S306), the CPU 41 proceeds directly to step S308.

In step S308, the CPU 41 updates the date and time update history 431. Next, the CPU 41 proceeds to step S309 and determines whether the automatic satellite radio wave reception flag 432 is currently set. If it is determined that the flag is currently set (YES in step S309), the CPU 41 proceeds to step S310 and resets the automatic satellite radio wave reception flag 432. The CPU 41 then ends the date and time update control process. Meanwhile, if it is determined that the flag is not currently set (NO in step S309), the CPU 41 ends the date and time update control process.

Among the steps described above, steps S304 and S305 are part of a date and time update step (a date and time update unit).

Figure 3:
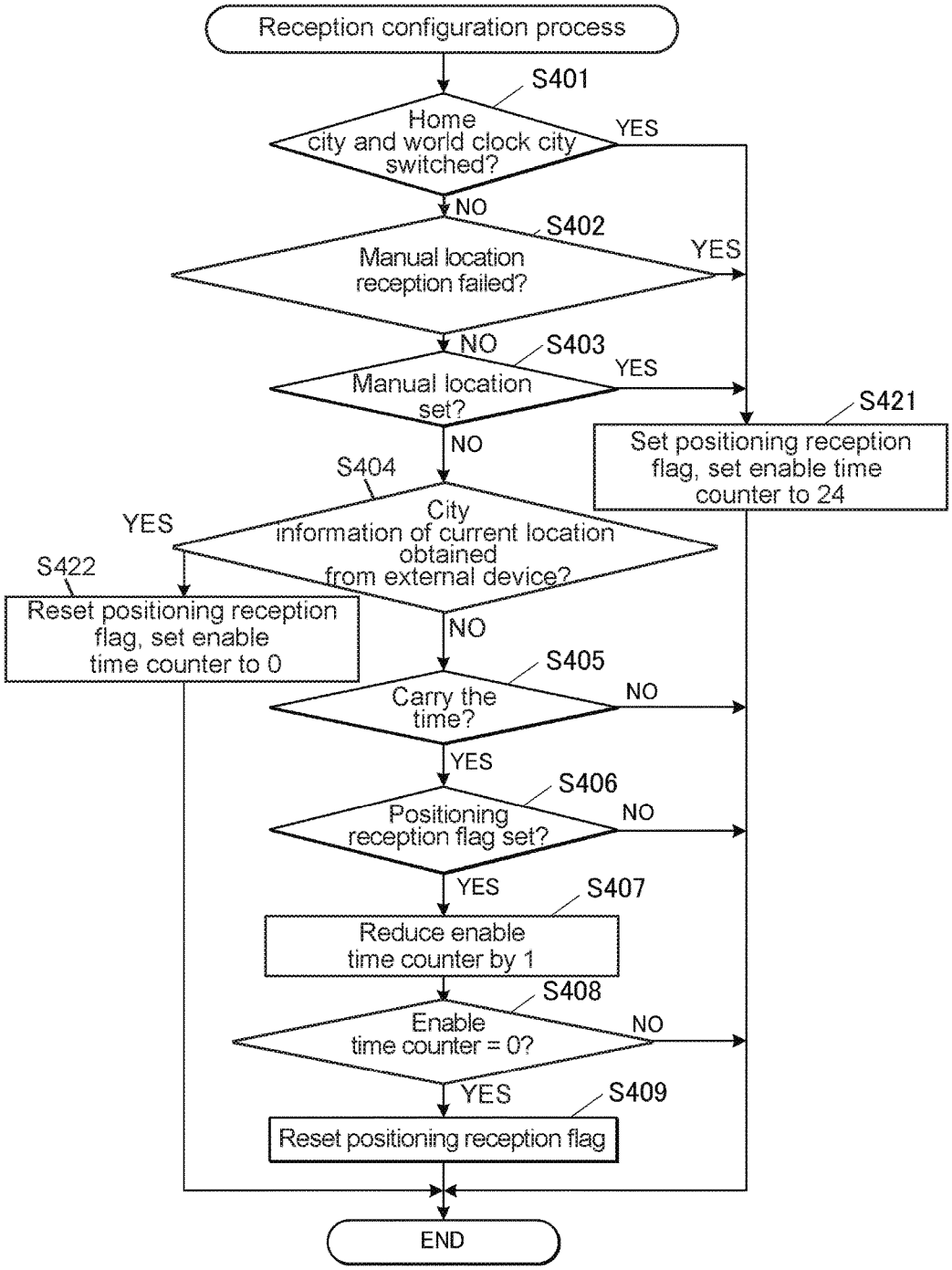
FIG. 3 is a flowchart illustrating a control procedure for a reception configuration process performed by the electronic timepiece according to Embodiment 1.

FIG. 3 is a flowchart illustrating a control procedure for the CPU 41 for the reception configuration process performed by the electronic timepiece 1 according to Embodiment 1.

This reception configuration process is executed when user input operations for changing settings such as the time zone are received by the operation receiving unit 61 and when the time is carried (that is, each hour at 0 minutes and 0 seconds).

Once the reception configuration process begins, the CPU 41 of the microcomputer 40 proceeds to step S401 and determines whether the home city and a world clock city have been switched. If it is determined that the home city and a world clock city have been switched (YES in step S401), the CPU 41 proceeds to step S421, sets the positioning reception flag 433, and sets the value of the enable time counter 434 to 24. The CPU 41 then ends the reception configuration process.

If it is determined that the home city and a world clock city have not been switched (NO in step S401), the CPU 41 proceeds to step S402 and determines whether a positioning command was input due to a manual user operation and whether the resulting positioning operation (receipt of the information needed for positioning) failed. If it is determined that the positioning operation triggered by the manual positioning command failed (YES in step S402), the CPU 41 proceeds to step S421.

If it is determined that no manual positioning command was received or that the positioning operation triggered by the manual positioning command did not fail (succeeded) (NO in step S402), the CPU 41 proceeds to step S403 and determines whether the home city was set manually on the basis of the user operation. If it is determined that the home city was set (YES in step S403), the CPU 41 proceeds to step S421.

If it is determined that the home city was not set due to the user operation (NO in step S403), the CPU 41 proceeds to step S404 and determines whether city information corresponding to the current location was obtained from the external device via the communication unit 63. If it is determined that city information was obtained from the external device (YES in step S404), the CPU 41 proceeds to step S422, resets the positioning reception flag 433, and sets the value of the enable time counter 434 to 0. The CPU 41 then ends the reception configuration process.

Meanwhile, if it is determined that city information was not obtained from the external device (NO in step S404), the CPU 41 proceeds to step S405 and determines whether it is time to carry the time. If it is determined that it is not time to carry the time (NO in step S405; in most cases the process does not branch here), the CPU 41 ends the reception configuration process.

If it is determined that it is time to carry the time (YES in step S405), the CPU 41 proceeds to step S406 and determines whether the positioning reception flag 433 is set. If it is determined that the flag is not set (NO in step S406), the CPU 41 ends the reception configuration process. If it is determined that the flag is set (YES in step S406), the CPU 41 proceeds to step S407 and reduces the value of the enable time counter 434 by 1. The CPU 41 then proceeds to step S408 and determines whether the value of the enable time counter 434 after being reduced is equal to 0. If it is determined that the value is not equal to 0 (NO in step S408), the CPU 41 ends the reception configuration process. If it is determined that the value is equal to 0 (YES in step S408) the CPU 41 proceeds to step S409 and resets the positioning reception flag 433. The CPU 41 then ends the reception configuration process.

Among the steps described above, steps S401 to S403, S421, and the like constitute a reception information configuration step (a reception information configuration unit).

Figure 4:
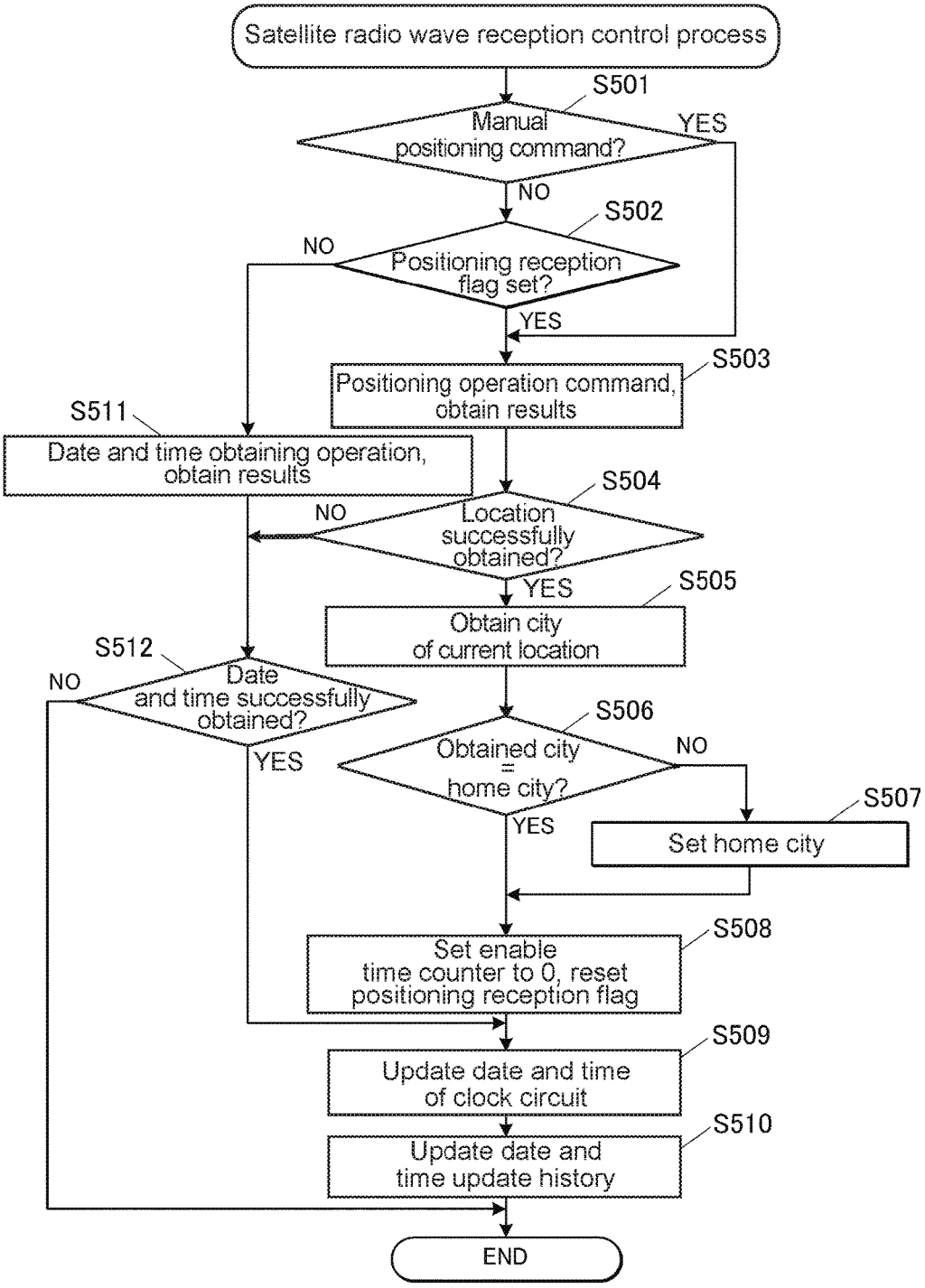
FIG. 4 is a flowchart illustrating a control procedure for a satellite radio wave reception control process performed by the electronic timepiece according to Embodiment 1.

FIG. 4 is a flowchart illustrating a control procedure for the CPU 41 for the satellite radio wave reception control process performed by the electronic timepiece 1 according to Embodiment 1.

This satellite radio wave reception control process is executed automatically at a timing at which the light sensor 64 first detects a prescribed amount of light each day while the automatic satellite radio wave reception flag 432 is set, and is also executed when the user performs a prescribed input operation to make the satellite radio wave reception processor 50 receive satellite radio waves.

Once the satellite radio wave reception control process begins, the CPU 41 proceeds to step S501 and determines whether a positioning command has been received due to a user input operation. If it is determined that a positioning command has been received (YES in step S501), the CPU 41 proceeds to step S503.

If it is determined that a positioning command has not been received (NO in step S501), the CPU 41 proceeds to step S502 (reception information switching step; reception information switching unit) and determines whether the positioning reception flag 433 is set. If it is determined that the flag is set (YES in step S502), the CPU 41 proceeds to step S503. If it is determined that the flag is not set (NO in step S502), the CPU 41 proceeds to step S511, activates the satellite radio wave reception processor 50 and outputs a date and time information retrieval command thereto, and then waits for a response from the satellite radio wave reception processor 50 and obtains the retrieval result. The CPU 41 then proceeds to step S512.

Upon proceeding to step S503 from step S501 or step S502, the CPU 41 activates the satellite radio wave reception processor 50 and outputs a positioning command thereto, and then waits for a response from the satellite radio wave reception processor 50 and obtains the positioning result.

The CPU 41 then proceeds to step S504 and determines whether the current location was successfully obtained from the positioning process performed by the satellite radio wave reception processor 50. If it is determined that the current location was not successfully obtained (positioning failed; NO in step S504), the CPU 41 proceeds to step S512.

If it is determined that the current location was successfully obtained (YES in step S504), the CPU 41 proceeds to step S505 and gets the home city corresponding to the current location. Then, the CPU 41 proceeds to step S506 and determines whether the obtained home city matches the currently set home city (that is, whether the home city setting is correct). If it is determined that the home cities do not match (NO in step S506), the CPU 41 proceeds to step S507 and updates the home city setting. Next, the CPU 41 then proceeds to step S508, sets the value of the enable time counter 434 to 0, and resets the positioning reception flag 433. The CPU 41 then proceeds to step S509.

Meanwhile, if it is determined that the obtained home city matches the currently set home city (the setting is correct; YES in step S506), the CPU 41 proceeds directly to step S508.

Upon proceeding to step S512 from step S511 or step S504, the CPU 41 determines whether the satellite radio wave reception processor 50 successfully obtained date and time information. If it is determined that date and time information was successfully obtained (YES in step S512), the CPU 41 proceeds to step S509. If it is determined that date and time information was not successfully obtained (retrieval failed; NO in step S512) the CPU 41 ends the satellite radio wave reception control process.

Upon proceeding to step S509 from step S508 or step S512, the CPU 41 updates the date and time of the clock circuit 48 on the basis of the obtained date and time information. The CPU 41 then proceeds to step S510 and updates the date and time update history 431, and then ends the satellite radio wave reception control process.

Among the steps of the satellite radio wave reception control process described above, steps S511 and S509 are part of the date and time update step (the date and time update unit).

As described above, the electronic timepiece 1 according to Embodiment 1 includes the clock circuit 48 that keeps the current date and time, the satellite radio wave reception processor 50 (receiver 51) that receives transmitted radio waves from positioning satellites, the operation receiving unit 61 that receives input operations, and the control unit that is constituted by the CPU 41 and the module controller 52. The control unit outputs, on the basis of the current date and time kept by the clock circuit 48, local times in one or a plurality of setting regions including at least a home city corresponding to the current location of the electronic timepiece. Moreover, when the receiver 51 performs reception operations for receiving the transmitted radio waves, the control unit makes the receiver 51 perform, in accordance with desired target information, any of a date and time reception process for obtaining date and time information and a positioning reception process for obtaining information needed to obtain the current location of the electronic timepiece (date and time information and information related to the orbits of the positioning satellites). Furthermore, the control unit obtains date and time information from an external source (here, positioning satellites from which radio waves can be received via the receiver 51, and external devices with which communication connections can be established via the communication unit 63) at a prescribed frequency and updates the current time kept by the clock circuit 48. In addition, when the operation receiving unit 61 receives a prescribed input operation for changing the home city, the control unit causes the positioning reception process to be performed at least once in the reception operations that are performed, after an operation corresponding to the prescribed input operation, until the city (current region) corresponding to the actual current location of the electronic timepiece is obtained (including when obtained from an external device).

Thus, the positioning reception process is not performed more often than necessary, which makes it possible to obtain just the date and time information in a short period of time and thereby reduce power consumption while maintaining the accuracy of the date and time kept by the clock circuit 48. Meanwhile, when the home city setting is changed in accordance with a user operation, it is possible to appropriately confirm whether the new home city is correctly set to the location of the electronic timepiece 1 after the user travels.

In this case, if the positioning process is triggered by a manual user operation before performing an automatic reception of radio waves to obtain date and time information, the positioning result is reflected, and there is no need for subsequent positioning when automatically receiving radio waves to obtain date and time information.

Moreover, if, after the input operation for changing the home city, current location information for the electronic timepiece 1 is obtained from an external device prior to a reception operation being performed (that is, if no reception operations are performed during the period of time until the current location information is obtained), there is no need to perform the positioning reception process again in subsequent reception operations, thereby making it possible to inhibit increases in power consumption.

Furthermore, the control unit causes the positioning reception process to be performed at least during the reception operation for receiving the transmitted radio waves from the positioning satellites that is executed first after the operation corresponding to the prescribed input operation for changing the home city.

This makes it possible, when automatically receiving transmitted radio waves from the positioning satellites, to obtain location information quickly without incurring a time lag that is longer than necessary and then check the home city that was set.

Furthermore, the control unit causes the positioning reception process to be performed during the reception operations executed within a prescribed maximum period of time (here, 24 hours) after the operation corresponding to the prescribed input operation for changing the home city. In the electronic timepiece 1, radio waves are normally received at a prescribed frequency (here, once per day) when a radio wave reception condition is satisfied. Repeatedly performing the positioning reception process while radio wave reception strength is poor needlessly increases power consumption. Meanwhile, if the number of reception attempts is restricted, changing settings prior to actually traveling and then attempting to receive radio waves before arriving at the destination, for example, reduces the number of remaining reception attempts available. Therefore, setting a maximum period of time as described above makes it possible to perform the positioning operation at an appropriate timing and frequency, thereby making it possible to more reliably check the home city setting.

In addition, the control unit causes the reception operation for receiving radio waves from the positioning satellites to be performed to obtain date and time information when a prescribed reception condition (here, detection of a reference amount of light or greater by the light sensor 64) is first satisfied during each period of time corresponding to the prescribed frequency related to updating date and time information, and then updates the current time. Thus, date and time information is obtained regularly and at a timing when reception of radio waves is more likely to succeed.

Therefore, while automatically receiving radio waves from positioning satellites at an appropriate frequency, switching from the date and time reception process to the positioning reception process to obtain information related to the current location only when necessary makes it possible to effectively reduce power consumption.

Moreover, in this embodiment, in accordance with a user input operation corresponding to a command for switching, among the plurality of setting regions, a first setting region corresponding to the home city and a second setting region corresponding to a world clock city, the control unit switches the first setting region and the second setting region to change the home city to a city defined as the second setting region (world clock city).

Thus, when the home city is specified using a simple operation, it is possible to easily check whether the specified home city actually corresponds to the current location of the travel destination without excessively increasing power consumption.

Furthermore, the control unit causes the positioning reception process to be performed in accordance with an input operation corresponding to a manual location retrieval command that changes the home city on the basis of the current location of the electronic timepiece 1 obtained via positioning, and if the information needed to obtain the current location of the electronic timepiece 1 fails to be obtained by the positioning reception process, after the failure occurs, the control unit causes the positioning reception process to be performed at least once in the reception operations that are performed until the current location of the electronic timepiece 1 is obtained.

Regardless of whether the positioning reception process is performed due to a user operation, if positioning fails, repeatedly performing the positioning reception process multiple times within a short period of time is disadvantageous in terms of the power consumption of the electronic timepiece 1. Therefore, establishing an appropriate interval and automatically triggering the positioning reception process at an appropriate timing when reception of radio waves is likely to succeed makes it possible to reliably obtain current location information to check the home city setting and also makes it possible to change the setting to a city corresponding to the current location even if the user does not change the appropriate setting and simply leaves the electronic timepiece alone, for example.

In addition, when the home city that was changed on the basis of the prescribed input operation for changing the home city and a city corresponding to the obtained current location of the electronic timepiece 1 are different, the control unit changes the home city setting to the city corresponding to the current location of the electronic timepiece 1 that was obtained on the basis of the positioning reception process.

Therefore, the home city setting is updated automatically even if the user configures the setting incorrectly, for example, thereby making it possible to reduce the probability of time-related issues or the like at the destination. Furthermore, particularly when the user sets the home city to match the current time at the destination, for example, even if the home city is incorrect due to daylight saving time being in effect or the like, the setting is automatically updated, thereby making it possible to avoid situations in which the wrong time is displayed when the daylight saving time status changes or the like.

Moreover, the electronic timepiece 1 further includes the communication unit 63 that communicates wirelessly with an external device, and the control unit can obtain date and time information and information related to the home city corresponding to the current location of the electronic timepiece 1 (here, the obtained information is the current location of the external device) from the external device via the communication unit 63.

Thus, when date and time information and current location information can be obtained from an external source using Bluetooth or the like, the satellite radio waves do not need to be received. In this case, these information pieces are obtained and used more easily and at lower power consumption. Furthermore, when the current location information (home city) is obtained from the external device as described above, there is no need to cause the positioning reception process to be received when receiving radio waves.

In addition, a method of controlling location information retrieval for the electronic timepiece 1 according to the present embodiment includes: a reception information switching step (step S502 in the satellite radio wave reception control process) of, when the receiver 51 performs reception operations for receiving transmitted radio waves from positioning satellites, making the receiver 51 perform, in accordance with the positioning reception flag 433 set on the basis of the desired target information, any of a date and time reception process for obtaining date and time information and a positioning reception process for obtaining information needed to obtain a current location of the electronic timepiece 1 (date and time and orbit information); a date and time update step (steps S304 and S305 in the date and time update control process and steps S511 and S509 in the satellite radio wave reception control process) of obtaining date and time information from an external source at a prescribed frequency and updating the current date and time kept by the clock circuit 48; and a reception information configuration step (steps S401 to S403, S421, and the like in the reception configuration process) of, when the operation receiving unit 61 receives a prescribed input operation for changing the home city, causing the positioning reception process to be performed at least once in the reception operations for receiving transmitted radio waves from the positioning satellites that are performed, after an operation corresponding to the prescribed input operation for changing the home city, until a city corresponding to the actual current location of the electronic timepiece 1 is obtained.

Thus, by normally performing only the date and time reception process to shorten reception times and reduce power consumption as long as there is no positioning command or the like from the user, and then performing the positioning reception process when there is an input operation for changing the home city, it is possible to efficiently and reliably check whether the appropriate home city was set.

Furthermore, making a computer in the electronic timepiece 1 perform the processes described above makes it possible to, simply by installing and executing the control programs 421, implement software control to easily and appropriately control which information is received when receiving radio waves from positioning satellites and to thereby improve reception times and power consumption efficiency.

Embodiment 2

Next, an electronic timepiece 1*a* according to Embodiment 2 will be described.

Figure 5:
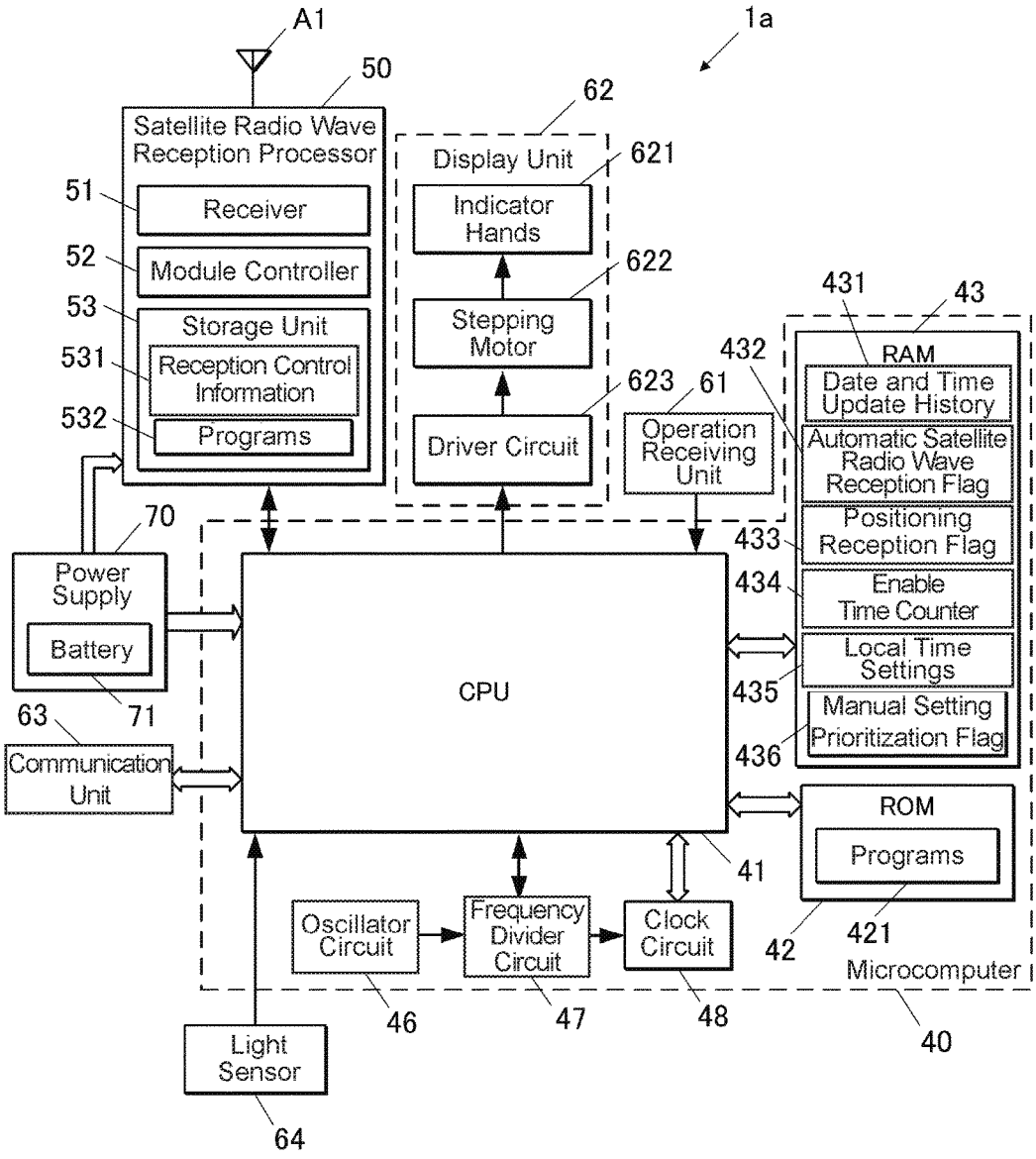
FIG. 5 is a block diagram illustrating a functional configuration of an electronic timepiece according to Embodiment 2.

FIG. 5 is a block diagram illustrating a functional configuration of the electronic timepiece 1*a* according to Embodiment 2.

The electronic timepiece 1*a* is the same as the electronic timepiece 1 according to Embodiment 1 except in that the RAM 43 further stores and maintains a manual setting prioritization flag 436 (a priority setting). The same reference characters will be used for components that are the same, and descriptions of such components will be omitted.

The manual setting prioritization flag 436 specifies which city to prioritize if, after the home city is set manually, the satellite radio wave reception processor 50 performs the positioning reception process and if the city corresponding to the current location obtained in the positioning process performed by the satellite radio wave reception processor 50 is different from the manually set home city. When the flag is set, the manually set home city is prioritized, and when the flag is reset, the city corresponding to the positioning result (the actual current location of the electronic timepiece) is prioritized. When this flag is set, the positioning reception process is not triggered by the operation of manually setting the home city.

Next, operations for getting the date and time and the current location in the electronic timepiece 1*a* according to the present embodiment will be described.

Figure 6:
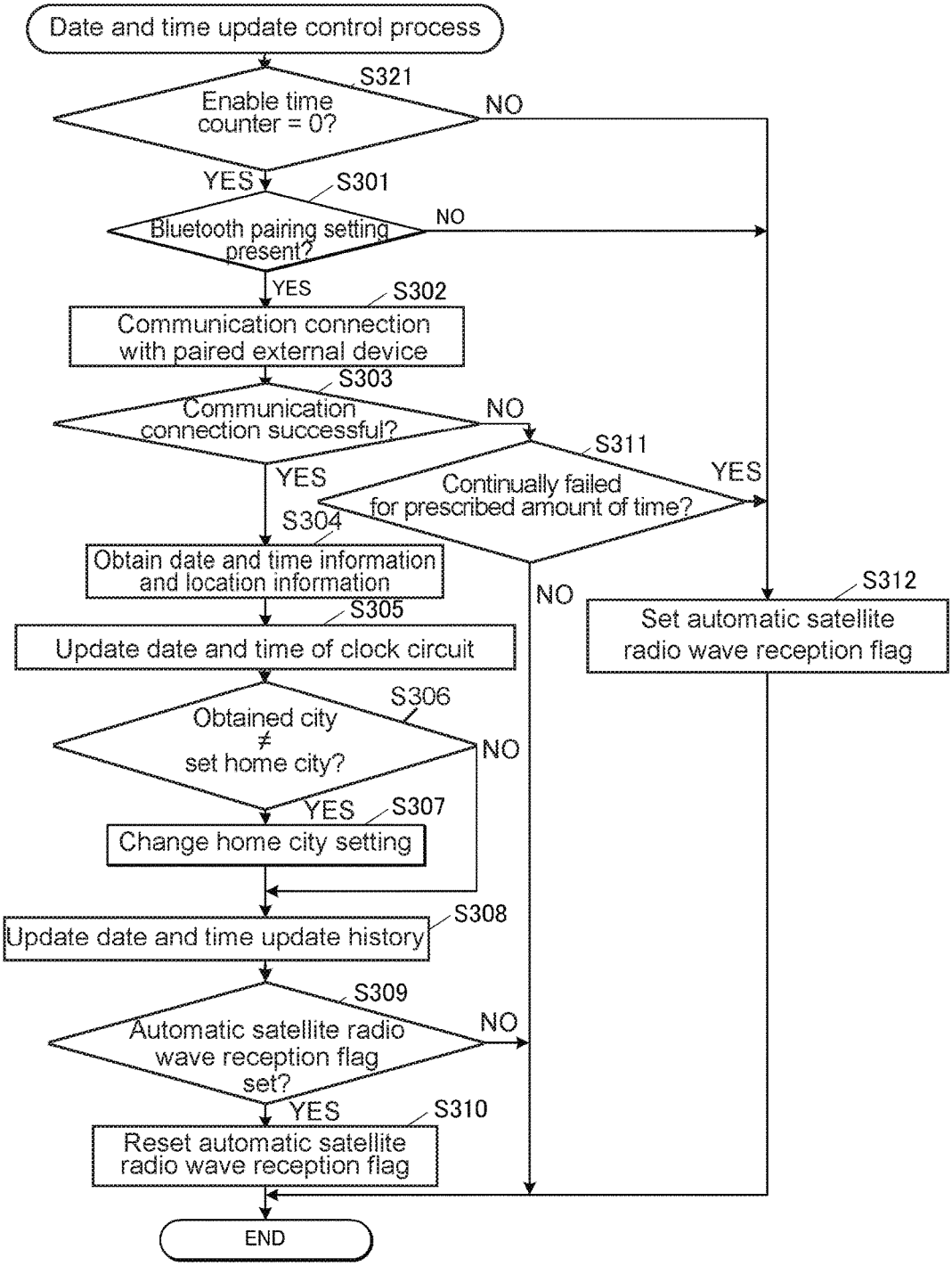
FIG. 6 is a flowchart illustrating a control procedure for a date and time update control process performed by the electronic timepiece according to Embodiment 2.

FIG. 6 is a flowchart illustrating a control procedure for the CPU 41 for a date and time update control process performed by the electronic timepiece 1*a* according to Embodiment 2.

This date and time update control process is only different from the date and time update control process performed by the electronic timepiece 1 according to Embodiment 1 in that step S321 is added. The same reference characters will be used for the other steps that are the same, and detailed descriptions of such steps will be omitted here.

Once the date and time update control process begins, the CPU 41 proceeds to step S321 and determines whether the value of the enable time counter 434 is equal to 0. If it is determined that the value is equal to 0 (YES in step S321) the CPU 41 proceeds to step S301 and continues the process in the same manner as in the electronic timepiece 1 according to Embodiment 1.

If it is determined that the value of the enable time counter 434 is not equal to 0 (NO in step S321), the CPU 41 proceeds to step S312 and sets the automatic satellite radio wave reception flag. The CPU 41 then ends the date and time update control process.

In other words, in the electronic timepiece 1*a* according to the present embodiment, when the date and time are changed manually, receipt of date and time and location information via Bluetooth is suspended until the value of the enable time counter 434 becomes equal to 0.

Figure 7:
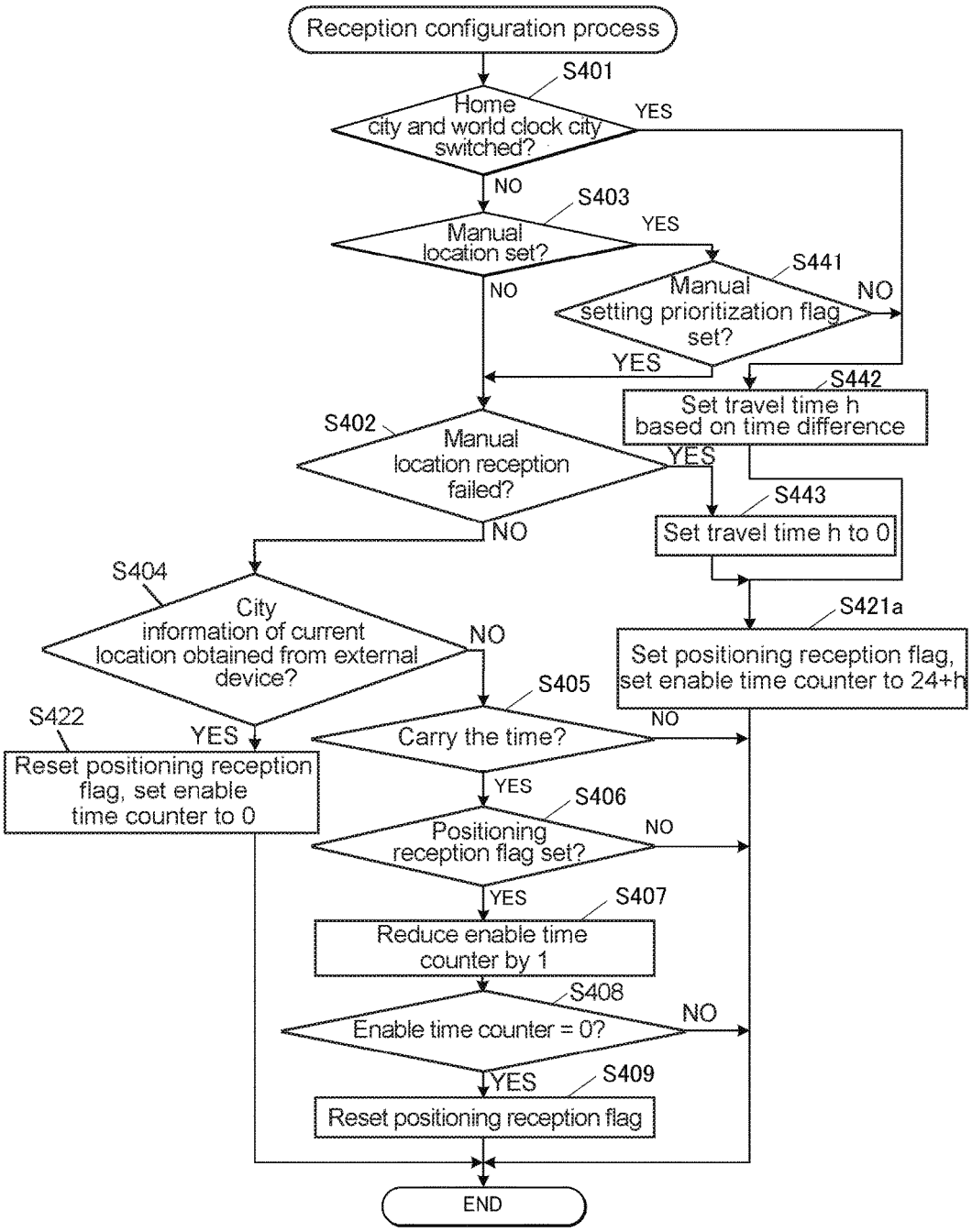
FIG. 7 is a flowchart illustrating a control procedure for a reception configuration process performed by the electronic timepiece according to Embodiment 2.

FIG. 7 is a flowchart illustrating a control procedure for the CPU 41 for a reception configuration process performed by the electronic timepiece 1*a* according to Embodiment 2.

This reception configuration process is different from the reception configuration process performed by the electronic timepiece 1 according to Embodiment 1 in that steps S441 to S443 are added, step S421 is replaced with step S421*a*, and the order of steps S402 and S403 is reversed. The details of the other steps are the same in the electronic timepiece 1*a* according to Embodiment 2 as in the electronic timepiece 1 according to Embodiment 1. The same reference characters will be used for these steps that are the same, and descriptions of these steps will be omitted here.

Here, if the result of the determination in step S401 is YES, the CPU 41 proceeds to step S442, calculates the time difference between the local time prior to being changed and the local time after being changed, and calculates a travel time h for a typical aircraft on the basis of this time difference. An estimation is sufficient for this travel time h, which may be equal to approximately the minimum possible travel time or a time period slightly shorter than this minimum possible time, for example. Next, the CPU 41 proceeds to step S421*a*, sets the positioning reception flag, and sets the value of the enable time counter 434 to 24+h. The CPU 41 then ends the reception configuration process.

If the result of the determination in step S403 is YES, the CPU 41 proceeds to step S441 and determines whether the manual setting prioritization flag 436 is set. If the flag is set (that is, is in the state that prioritizes manual settings; YES in step S441), the CPU 41 proceeds to step S402. If the flag is not set (that is, is in the state that does not prioritize manual settings; NO in step S441), the CPU 41 proceeds to step S442.

Moreover, if the result of the determination process in step S402 is YES, the CPU 41 proceeds to step S443 and sets the travel time h to 0. The CPU 41 then proceeds to step S421*a*.

In this way, in the reception configuration process performed by the electronic timepiece 1*a* according to the present embodiment, the period of time during which radio waves can be received from positioning satellites (and the period of time during which receipt of date and time and current location information from external devices via Bluetooth is suspended) is extended on the basis of the travel time corresponding to the time difference. Therefore, even if the user changes the local time setting before boarding an airplane or immediately after boarding the airplane, for example, the period of time during which radio waves can be received from positioning satellites after the flight is extended by a conservative amount. Moreover, if the manual setting prioritization flag 436 is set, the user setting is prioritized and receipt of location information is proactively suspended.

Figure 8:
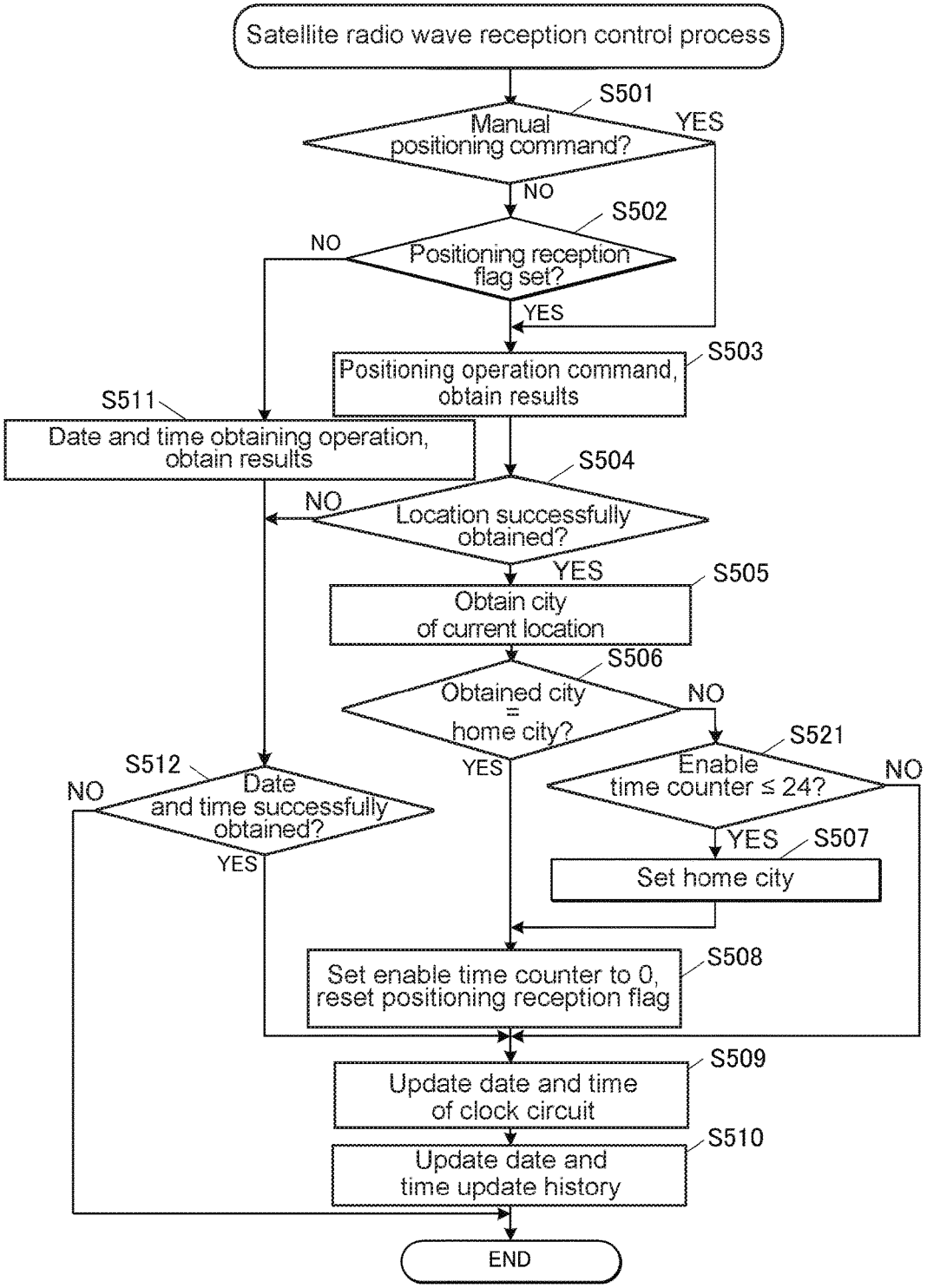
FIG. 8 is a flowchart illustrating a control procedure for a satellite radio wave reception control process performed by the electronic timepiece according to Embodiment 2.

FIG. 8 is a flowchart illustrating a control procedure for the CPU 41 for a satellite radio wave reception control process performed by the electronic timepiece 1*a* according to Embodiment 2.

This satellite radio wave reception control process is the same as the satellite radio wave reception control process performed by the electronic timepiece 1 according to Embodiment 1 except in that step S521 is added. The same reference characters will be used for steps that are the same, and descriptions of such steps will be omitted here.

If the result of the determination process in step S506 is NO, the CPU 41 proceeds to step S521 and determines whether the value of the enable time counter 434 is less than or equal to 24. If it is determined that the value is not less than or equal to 24 (NO in step S521), the CPU 41 proceeds to step S509. If it is determined that the value is less than or equal to 24 (YES in step S521), the CPU 41 proceeds to step S507.

Thus, in the satellite radio wave reception control process performed by the electronic timepiece 1*a* according to the present embodiment, until the travel time h set when the city setting is changed has elapsed, the city setting is not changed again even if an obtained city is different than the city that was set, and the positioning reception flag is not reset even once the positioning process is performed. Therefore, the specified city setting is not erroneously changed due to receiving radio waves and performing the positioning process or the like on the jetway while boarding an airplane prior to traveling or when making a transfer, for example. Meanwhile, if the city setting is changed after arriving at the destination or the like and then the positioning process is immediately performed and the obtained city matches the home city that was set, the current setting can be determined to be correct and it is no longer necessary to subsequently perform the positioning reception process. Moreover, while on the airplane, in most cases the condition for automatically receiving satellite radio waves will not be satisfied, and therefore during travel it is unlikely that satellite radio waves will be received more often than is necessary.

As described above, the electronic timepiece 1*a* according to Embodiment 2 includes the RAM 43 that stores the manual setting prioritization flag 436 related to whether to prioritize a home city that was directly specified via the operation receiving unit 61 over the city corresponding to the actual current location of the electronic timepiece 1*a*, and when the operation receiving unit 61 receives an input operation directly specifying a new home city, the control unit (the CPU 41 and the module controller 52) determines, in accordance with the manual setting prioritization flag 436, whether to cause the positioning reception process to be performed at least once in the reception operations for receiving radio waves from positioning satellites that are performed, after the new home city corresponding to the input operation is set, until the current location of the electronic timepiece 1*a* is obtained.

This makes it possible to, when the user intentionally sets a home city in a different time zone, prevent the home city setting from being changed against the user's wishes.

The present invention is not limited to the embodiments described above, and various modifications are possible.

For example, although in the embodiments described above both a home city setting and world clock city settings are maintained, the electronic timepiece may only have a home city setting.

Moreover, although the embodiments described above used both radio waves received from positioning satellites and communications sent via short-range wireless communications (Bluetooth), date and time and location information do not necessarily need to be obtained via short-range wireless communications, and features or components for short-range wireless communications do not necessarily need to be included.

Furthermore, although the embodiments described above use both the positioning reception flag 433 and the enable time counter 434, the state of the positioning reception flag 433 can be determined solely on the basis of whether the value of the enable time counter 434 is equal to 0, and therefore the positioning reception flag 433 does not necessarily need to be used.

In addition, although the embodiments described above set the enable time counter 434 to set the maximum time for which the positioning reception process is performed, a maximum time does not necessarily need to be set. Moreover, the value of the enable time counter 434 may be changed not only in accordance with the travel time h but also in accordance with other factors such as the radio wave reception strength, for example. Alternatively, a maximum number of times to receive radio waves may be set instead of a maximum time.

Furthermore, in the embodiments above, an embodiment in which specified locations are checked and updated even when cities are directly specified by manual operations as well as an embodiment in which whether locations are checked and updated is switched in accordance with the state of the manual setting prioritization flag 436 were described. However, cities that are directly specified by manual operations may alternatively be configured to never be checked or updated by the positioning process. In this case, the home city setting can still be changed when current location information is obtained via a Bluetooth communication connection with an external device.

In addition, although in the embodiments described above the condition for receiving satellite radio waves was the timing at which the light sensor 64 detects an amount of light greater than or equal to a prescribed reference value at a frequency of no more than once per day, conditions may be appropriately added or changed in accordance with the capacity or loading characteristics of the battery 71, for example.

Moreover, although the embodiments described above include the CPU 41 and the module controller 52 of the satellite radio wave reception processor 50 as the control unit, a single CPU (including one with multiple cores) may centrally handle control operations. Furthermore, these control operations are not limited to software control executed by a CPU, and some control operations may be implemented in the form of hardware configurations such as dedicated logic circuits, for example.

Moreover, although the description above presented the ROM 42 (including non-volatile memory) as an example of a computer-readable medium for the programs 421 for processes such as controlling the operation of the dial that are executed by the CPU 41, the present invention is not limited to this example. Examples of other computer-readable media that can be used include hard disk drives (HDDs) and portable storage media such as CD-ROMs and DVDs.

Furthermore, low-level details such as the configurations and control process details and procedures of the embodiments described above can be modified as appropriate without departing from the spirit of the present invention.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. An electronic timepiece, comprising:

a clock that keeps a current time;

a radio wave receiver that receives radio waves transmitted from positioning satellites;

an operation receiving unit that receives input operations; and a control unit, wherein the control unit calculates, on the basis of the current time kept by the clock, a local time or local times in one or a plurality of setting regions including at least a current region in which the electronic timepiece is currently located, wherein when the radio wave receiver performs reception operations that attempt to receive the radio waves, the control unit makes the radio wave receiver perform either one of a date and time reception process that attempts to obtain date and time information from the radio waves without obtaining additional information from the radio waves needed to determine a current location of the electronic timepiece or a positioning reception process that attempts to obtain all of information from the radio waves that is needed to determine the current location of the electronic timepiece, wherein when the operation receiving unit receives a prescribed input operation that affects the current region and, if the prescribed input operation manually changes a current region setting, when the control unit is not set to prioritize said manually changed current region setting, the control unit makes the radio wave receiver perform the positioning reception process at least once before a prescribed location updating event that determines a current location of the electronic timepiece occurs, the prescribed location updating event being when the current location of the electronic timepiece is determined by a communication with an external device or by successfully performing the positioning reception process that occurs immediately or a prescribed time period after the reception of the prescribed input operation, whichever occurs first after the reception of the prescribed input operation, and wherein when the prescribed location updating event occurs, the control unit makes the radio wave receiver stop the reception operations that attempt to receive the radio waves or the control unit makes the radio wave receiver perform only the date and time reception process when performing the reception operations until another prescribed input operation that affects the current region is received.

2. The electronic timepiece according to claim 1, wherein the control unit makes the radio wave receiver perform the positioning reception process at least in the reception operation that is executed first after the prescribed input operation is received.

3. The electronic timepiece according to claim 2, wherein the control unit makes the radio wave receiver perform the positioning reception process in at least one of the reception operations that are executed within a prescribed maximum period of time after the prescribed input operation is received.

4. The electronic timepiece according to claim 2, further comprising:

a communication unit that is configured to attempt to communicate with the external device at a prescribed frequency, wherein the control unit makes the radio wave receiver perform a reception operation to obtain date and time information from the positioning satellites when a prescribed condition is first satisfied during each period of time corresponding to said prescribed frequency, and then updates the current time kept by the clock if said reception operation is successful.

5. The electronic timepiece according to claim 2, wherein the prescribed input operation that affects the current region is a user operation to instruct the control unit to switch, among the plurality of setting regions, a first setting region corresponding to the current region with a second setting region, and the control unit changes the current region to the second setting region in response to the prescribed input operation.

6. The electronic timepiece according to claim 2, wherein the prescribed input operation that affects the current region is a user operation to instruct the control unit to determine a current location of the electronic timepiece by communicating with the positioning satellites and update the current region based on the determined current location, and wherein in response to the prescribed input operation, the control unit makes the radio wave receiver perform the positioning reception process, and if said positioning reception process is not successful, the control unit makes the radio wave receiver perform the positioning reception process at a prescribed interval before said prescribed location updating event occurs.

7. The electronic timepiece according to claim 1, wherein the control unit makes the radio wave receiver perform the positioning reception process in at least one of the reception operations that are executed within a prescribed maximum period of time after the prescribed input operation is received.

8. The electronic timepiece according to claim 7, further comprising:

a communication unit that is configured to attempt to communicate with the external device at a prescribed frequency, wherein the control unit makes the radio wave receiver perform a reception operation to obtain date and time information from the positioning satellites when a prescribed condition is first satisfied during each period of time corresponding to said prescribed frequency, and then updates the current time kept by the clock if said reception operation is successful.

9. The electronic timepiece according to claim 7, wherein the prescribed input operation that affects the current region is a user operation to instruct the control unit to switch, among the plurality of setting regions, a first setting region corresponding to the current region with a second setting region, and the control unit changes the current region to the second setting region in response to the prescribed input operation.

10. The electronic timepiece according to claim 7, wherein the prescribed input operation that affects the current region is a user operation to instruct the control unit to determine a current location of the electronic timepiece by communicating with the positioning satellites and update the current region based on the determined current location, and wherein in response to the prescribed input operation, the control unit makes the radio wave receiver perform the positioning reception process, and if said positioning reception process is not successful, the control unit makes the radio wave receiver perform the positioning reception process at a prescribed interval before said prescribed location updating event occurs.

11. The electronic timepiece according to claim 1, further comprising:

a communication unit that is configured to attempt to communicate with the external device at a prescribed frequency, wherein the control unit makes the radio wave receiver perform a reception operation to obtain date and time information from the positioning satellites when a prescribed condition is first satisfied during each period of time corresponding to said prescribed frequency, and then updates the current time kept by the clock if said reception operation is successful.

12. The electronic timepiece according to claim 11, wherein the prescribed input operation that affects the current region is a user operation to instruct the control unit to switch, among the plurality of setting regions, a first setting region corresponding to the current region with a second setting region, and the control unit changes the current region to the second setting region in response to the prescribed input operation.

13. The electronic timepiece according to claim 11, wherein the prescribed input operation that affects the current region is a user operation to instruct the control unit to determine a current location of the electronic timepiece by communicating with the positioning satellites and update the current region based on the determined current location, and wherein in response to the prescribed input operation, the control unit makes the radio wave receiver perform the positioning reception process, and if said positioning reception process is not successful, the control unit makes the radio wave receiver perform the positioning reception process at a prescribed interval before said prescribed location updating event occurs.

14. The electronic timepiece according to claim 1, wherein the prescribed input operation that affects the current region is a user operation to instruct the control unit to switch, among the plurality of setting regions, a first setting region corresponding to the current region with a second setting region, and the control unit changes the current region to the second setting region in response to the prescribed input operation.

15. The electronic timepiece according to claim 1, wherein the prescribed input operation that affects the current region is a user operation to instruct the control unit to determine a current location of the electronic timepiece by communicating with the positioning satellites and update the current region based on the determined current location, and wherein in response to the prescribed input operation, the control unit makes the radio wave receiver perform the positioning reception process, and if said positioning reception process is not successful, the control unit makes the radio wave receiver perform the positioning reception process at a prescribed interval before said prescribed location updating event occurs.

16. The electronic timepiece according to claim 1, wherein the prescribed input operation that affects the current region is a user operation that changes the current region, and when the current region that was changed by the prescribed input operation does not match the current location of the electronic timepiece that was determined by the prescribed location updating event, the control unit replaces the changed current region with a region corresponding to the current location of the electronic timepiece that was determined by the prescribed location updating event.

17. The electronic timepiece according to claim 1, wherein the prescribed operation that affects the current region is an operation by a user that manually changes the current region setting, and wherein the electronic timepiece further comprises:

a settings storage unit that stores user changeable priority setting information that determines whether to prioritize the current region setting that is manually set by the user via said prescribed input operation, and wherein when the operation receiving unit receives said prescribed input operation, the control unit determines, in accordance with the priority setting information, whether to make the radio wave receiver perform the positioning reception process at least once before said prescribed location updating event occurs.

18. The electronic timepiece according to claim 1, further comprising:

a communication unit that is configured to attempt to communicate with the external device wirelessly at a prescribed frequency, wherein the control unit obtains date and time information and information related to the current region corresponding to the current location of the electronic timepiece from the external device via the communication unit when the communication unit successfully communicates with the external unit.

19. A method of controlling location information retrieval to be performed by a control unit in an electronic timepiece, the electronic timepiece including a clock that keeps a current time, a radio wave receiver that receives radio waves transmitted from positioning satellites, an operation receiving unit that receives input operations, and said control unit, the control unit calculating, on the basis of the current time kept by the clock, a local time or local times in one or a plurality of setting regions including at least a current region in which the electronic timepiece is currently located, the method comprising having the control unit perform the following:

when the radio wave receiver performs reception operations that attempt to receive the radio waves, making the radio wave receiver perform either one of a date and time reception process that attempts to obtain date and time information from the radio waves without obtaining additional information from the radio waves needed to determine a current location of the electronic timepiece or a positioning reception process that attempts to obtain all of information from the radio waves that is needed to determine the current location of the electronic timepiece;

when the operation receiving unit receives a prescribed input operation that affects the current region and, if the prescribed input operation manually changes a current region setting, when the control unit is not set to prioritize said manually changed current region setting, making the radio wave receiver perform the positioning reception process at least once before a prescribed location updating event that determines a current location of the electronic timepiece occurs, the prescribed location updating event being when the current location of the electronic timepiece is determined by a communication with an external device or by successfully performing the positioning reception process that occurs immediately or a prescribed time period after the reception of the prescribed input operation, whichever occurs first after the reception of the prescribed input operation; and when the prescribed location updating event occurs, making the radio wave receiver stop the reception operations that attempt to receive the radio waves or making the radio wave receiver perform only the date and time reception process when performing the reception operations until another prescribed input operation that affects the current region is received.

20. A non-transitory storage medium having stored therein instructions executable by one or more processors in an electronic timepiece, the electronic timepiece including a clock that keeps a current time, a radio wave receiver that receives radio waves transmitted from positioning satellites, an operation receiving unit that receives input operations; and said one or more processors, the said one or more processor calculating, on the basis of the current time kept by the clock, a local time or local times in one or a plurality of setting regions including at least a current region in which the electronic timepiece is currently located, the instructions causing the one or more processors in the electronic timepiece to perform the following:

when the radio wave receiver performs reception operations that attempt to receive the radio waves, making the radio wave receiver perform either one of a date and time reception process that attempts to obtain date and time information from the radio waves without obtaining additional information from the radio waves needed to determine a current location of the electronic timepiece or a positioning reception process that attempts to obtain all of information from the radio waves that is needed to determine the current location of the electronic timepiece;

when the operation receiving unit receives a prescribed input operation that affects the current region and, if the prescribed input operation manually changes a current region setting, when the control unit is not set to prioritize said manually changed current region setting, making the radio wave receiver perform the positioning reception process at least once before a prescribed location updating event that determines a current location of the electronic timepiece occurs, the prescribed location updating event being when the current location of the electronic timepiece is determined by a communication with an external device or by successfully performing the positioning reception process that occurs immediately or a prescribed time period after the reception of the prescribed input operation, whichever occurs first after the reception of the prescribed input operation; and when the prescribed location updating event occurs, at least temporarily making the radio wave receiver stop the reception operations that attempt to receive the radio waves or making the radio wave receiver perform only the date and time reception process when performing the reception operations until another prescribed input operation that affects the current region is received.

* * * * *